US012233353B2

(12) United States Patent
Zhang

(10) Patent No.: US 12,233,353 B2
(45) Date of Patent: Feb. 25, 2025

(54) BUBBLE MACHINE

(71) Applicants: SHANG HAI LE YOUNG ELECTRONIC COMMERCE Co., Ltd., Shanghai (CN); JOYIN US CORP, Tempe, AZ (US)

(72) Inventor: Liuxian Zhang, Phoenix, AZ (US)

(73) Assignees: SHANG HAI LE YOUNG ELECTRONIC COMMERCE Co., Ltd., Shanghai (CN); JOYIN US CORP, Tempe, AZ (US)

( * ) Notice: Subject to any disclaimer, the term of this patent is extended or adjusted under 35 U.S.C. 154(b) by 0 days.

(21) Appl. No.: 18/772,371

(22) Filed: Jul. 15, 2024

(65) Prior Publication Data

US 2024/0375023 A1 Nov. 14, 2024

(30) Foreign Application Priority Data

Jun. 17, 2024 (CN) ..... 202410783803.2

(51) Int. Cl.
*A63H 33/28* (2006.01)

(52) U.S. Cl.
CPC ..... *A63H 33/28* (2013.01)

(58) Field of Classification Search
CPC ..... A63H 33/28
USPC ..... 446/15, 16
See application file for complete search history.

(56) References Cited

U.S. PATENT DOCUMENTS

| | | | | |
|---|---|---|---|---|
| 4,423,565 | A * | 1/1984 | Bart | A63H 33/28 446/16 |
| 5,462,469 | A * | 10/1995 | Lei | A63H 33/28 446/15 |
| 5,498,191 | A * | 3/1996 | DeMars | A63H 33/28 446/178 |
| 6,682,570 | B2 * | 1/2004 | Thai | A63H 33/28 446/15 |
| 6,860,782 | B2 * | 3/2005 | Hornsby | A63H 33/28 446/15 |
| 6,921,312 | B2 * | 7/2005 | Thai | A63H 33/28 446/176 |
| 7,056,182 | B2 * | 6/2006 | Wan | A63H 33/28 446/15 |
| 7,059,930 | B2 * | 6/2006 | Choi | A63H 33/28 446/178 |
| 7,086,920 | B2 * | 8/2006 | Fusco | A63H 33/28 446/15 |

(Continued)

*Primary Examiner* — Joseph B Baldori
(74) *Attorney, Agent, or Firm* — Hemisphere Law, PLLC; Zhigang Ma

(57) ABSTRACT

The present disclosure provides a bubble machine. The bubble machine includes a shell, a bubble forming part, and a motion and liquid introduction member, wherein the bubble forming part is arranged on the shell and is provided with a plurality of bubble forming units; the motion and liquid introduction member is arranged on the shell and is provided with a liquid inlet and a liquid outlet; the liquid inlet is configured to obtain bubble liquid and introduce the bubble liquid into the liquid outlet; the liquid outlet is arranged in a manner of corresponding to the bubble forming part; and the motion and liquid introduction member is configured to be driven to move to introduce the bubble liquid at the liquid outlet into the plurality of bubble forming units.

19 Claims, 8 Drawing Sheets

1

(56) References Cited

U.S. PATENT DOCUMENTS

| | | | | |
|---|---|---|---|---|
| 8,038,500 | B2 * | 10/2011 | Thai | A63H 33/28 446/179 |
| 8,636,557 | B2 * | 1/2014 | Lo | A63H 33/28 446/15 |
| 8,888,549 | B2 * | 11/2014 | Lo | A63H 33/28 446/16 |
| 10,434,433 | B1 * | 10/2019 | Thai | A63H 33/28 |
| 10,434,434 | B1 * | 10/2019 | Thai | A63H 29/22 |
| 2006/0163278 | A1 * | 7/2006 | Yeung | A63H 33/28 446/15 |
| 2007/0037467 | A1 * | 2/2007 | Thai | A63H 33/28 446/15 |
| 2007/0128968 | A1 | 6/2007 | Thai | |
| 2009/0142986 | A1 * | 6/2009 | San | A63H 33/28 446/15 |
| 2019/0126161 | A1 | 5/2019 | Yang | |
| 2019/0192989 | A1 * | 6/2019 | Kelly | A63H 33/28 |
| 2020/0139262 | A1 | 5/2020 | Yang | |

* cited by examiner

BUBBLE MACHINE

TECHNICAL FIELD

The present disclosure relates to the technical field of formation of bubbles, and in particular, to a bubble machine.

BACKGROUND

A bubble machine is generally used in the field of toys or scene atmosphere generation. A working principle of the bubble machine is usually to drive air to flow in a preset direction and form bubble films on a bubble forming part on an air flowing trajectory. The bubble films wrap a certain amount of air to form bubbles.

In the bubble machine of the related technology, the bubble forming part is provided with a plurality of bubble forming units configured to generate a plurality of bubbles. The bubble forming part is continuously moving under the driving of an external force, and the plurality of bubble forming units then simultaneously or sequentially generate a plurality of bubbles. However, the bubble forming part is always in a motion state, which may cause the formed bubbles to be easily broken, thereby affecting the use experience of the bubble machine.

SUMMARY

In view of this, it is actually necessary to provide a bubble machine in which bubbles formed by a bubble forming part are hardly broken.

The embodiments of the present disclosure provide a bubble machine. The bubble machine includes a shell, a bubble forming part, and a motion and liquid introduction member, wherein the bubble forming part is arranged on the shell and is provided with a plurality of bubble forming units; the motion and liquid introduction member is arranged on the shell and is provided with a liquid inlet and a liquid outlet; the liquid inlet is configured to obtain bubble liquid and introduce the bubble liquid into the liquid outlet; the liquid outlet is arranged in a manner of corresponding to the bubble forming part; and the motion and liquid introduction member is configured to be driven to move to introduce the bubble liquid at the liquid outlet into the plurality of bubble forming units, so that the plurality of bubble forming units can generate a plurality of bubbles using the introduced bubble liquid when there is an air flow motion in a preset direction.

Compared with the related technology, in the bubble machine provided in the embodiments of the present disclosure, by the arrangement of the motion and liquid introduction member, when the motion and liquid introduction member is driven to move, the bubble liquid at the liquid outlet is introduced into the plurality of bubble forming units, so that the plurality of bubble forming units can generate a plurality of bubbles using the introduced bubble liquid when there is an air flow motion in the preset direction. In the process of generating the bubbles, the bubble forming part does not need to move, and the motion and liquid introduction member conveys the bubble liquid to the plurality of bubble forming units through the motion, which can effectively avoid breakage of the formed bubbles, make the output of bubbles more stable, and enhance the use experience of the bubble machine.

In an embodiment, the bubble machine further includes a fan, a transmission device, and a driving device; the fan is configured to blow air towards the plurality of bubble forming units to generate the air flow motion in the preset direction; the transmission device is connected to the motion and liquid introduction member; and the driving device is connected to the fan and the transmission device and is configured to: drive the fan to rotate to generate the air flow motion in the preset direction, and drive the motion and liquid introduction member to move through the transmission device. By the arrangement of the transmission device, the driving device can drive the motion and liquid introduction member to move through the transmission device when driving the fan, so that the structure of the bubble machine is more compact, and the production costs can be saved.

In an embodiment, the driving device includes a driving main body and an output shaft connected to the driving main body; the output shaft is connected to the fan and the transmission device; the output shaft is provided with a transmission thread; the transmission device includes a gear module and a transmission member; the transmission member is provided with a first transmission tooth and a second transmission tooth; the motion and liquid introduction member is provided with a third transmission tooth; the gear module includes at least one gear; the gear module is in meshing connection with the transmission thread and the first transmission tooth; the second transmission tooth is in meshing connection with the third transmission tooth; when the driving main body drives the output shaft to rotate, the fan rotates to blow air, and the transmission thread drives the gear module to move; and the gear module drives the transmission member to move through the first transmission tooth, so that the second transmission tooth drives the motion and liquid introduction member to move. By the arrangement of the output shaft provided with the transmission thread, the gear module, and the transmission member, the gear module is in meshing connection with the transmission thread and the first transmission tooth; the second transmission tooth is in meshing connection with the third transmission tooth; when the driving main body drives the output shaft to rotate, the fan can be driven to rotate to blow air; meanwhile, the transmission thread drives the gear module to move; and the gear module drives the transmission member to move through the first transmission tooth, so that the second transmission tooth drives the motion and liquid introduction member to move, thus generating and blowing out bubbles. The whole process is stable and smooth in transmission, and stable outputting of the bubbles is ensured. Moreover, gears are engaged with the driving device to simultaneously drive the fan and the transmission device. The bubble machine is compact in structure and stable in working state, and the use experience of the bubble machine is enhanced.

In an embodiment, the shell includes a shell main body and a fixing member; the shell main body is provided with a mounting port; the fixing member is arranged in a manner of corresponding to the mounting port; the fixing member is provided with a mounting hole; the bubble machine further includes a liquid outlet member configured to obtain the bubble liquid; the liquid outlet member is mounted in the mounting hole; the motion and liquid introduction member includes a rotating member and a liquid storage member; the rotating member includes a base plate provided with the liquid inlet and a liquid guide slot communicating with the liquid inlet, an annularly arranged extending plate corresponding to the liquid inlet and extending from one side of the base plate towards the mounting hole, and a ringlike structure connected to and annularly arranged at an outer edge of the base plate; the ringlike structure is provided with the third transmission tooth; the extending plate is connected to the motion and liquid introduction member to communicate the liquid inlet with the liquid outlet member; the liquid storage member is arranged on one side of the base plate away from the extending plate and is provided with the liquid outlet; and the liquid outlet communicates with the liquid guide slot. By the arrangement of the liquid outlet member, the rotating member, and the liquid storage member, the bubble liquid can flow into the liquid inlet through the liquid outlet member, and be introduced into the liquid outlet through the liquid guide slot, so that the bubble liquid can accurately flow to the liquid outlet through the liquid inlet, avoiding leakage of the bubble liquid and ensuring the stability of the bubble machine blowing out bubbles, and enhancing the use experience of the bubble machine.

In an embodiment, an inner wall of the mounting hole includes a first portion, a second portion, and a connecting portion connected between the first portion and the second portion; the liquid outlet member includes a tube body provided with a liquid channel, and a fixed flange arranged at a periphery of the tube body; the tube body is divided by the fixed flange into a first tube portion close to the rotating member and a second tube portion far from the rotating member; the liquid channel penetrates through the first tube portion and the second tube portion; the first tube portion and the fixed flange are located in the first portion; the extending plate extends into the first portion and is located between the first portion and the first tube portion; the liquid inlet corresponds to the liquid channel of the first tube portion; the fixed flange is in contact with the connecting portion; and the second tube portion is at least partially located in the second portion. Since the first tube portion and the fixed flange are arranged in the first portion, the extending plate extends into the first portion and is located between the first portion and the first tube portion; the liquid inlet corresponds to the liquid channel of the first tube portion, so that the liquid outlet member, the rotating member, and the fixing member can be fixedly mounted, and it ensures that the rotating member can stably obtain the bubble liquid flowing out of the liquid outlet member during the motion, thereby ensuring the stability of the bubble machine blowing bubbles and enhancing the use experience of the bubble machine.

In an embodiment, the bubble machine further includes a sealing ring; the sealing ring sleeves an outer surface of the first tube portion and abuts between the extending plate and the first tube portion; and the outer surface of the first tube section is provided with a fixing groove; and the sealing ring is at least partially embedded in the fixing groove. By the arrangement of the sealing ring, the first tube portion can be tightly connected to the extending plate, to prevent the bubble liquid from flowing out and ensuring the safety of use of the bubble machine.

In an embodiment, the fixing member includes an enclosing portion enclosed to form the mounting hole, a plurality of partition plates connected to a periphery of the enclosing portion and spaced apart, and a ring wall structure annularly arranged at and connected to outer edges of the plurality of partition plates; the ring wall structure is mounted on an inner wall of the shell main body; and air of the fan is blown towards the bubble forming part through gaps between the plurality of partition plates. By the arrangement of the enclosing portion, the partition plates of the enclosing portion can not only play a role of strengthening and fixing, but also play a role of guiding air of the fan, so that the bubble machine blows out bubbles more stably, and the use experience of the bubble machine is enhanced.

In an embodiment, a limiting slot adjacent to the rotating member is further enclosed between the enclosing portion and the partition plates; the bubble machine further includes an elastic member; the elastic member is located in the limiting slot and abuts between the rotating member and the fixing member; and the elastic member is a spring sleeving the periphery of the enclosing portion. By the arrangement of the limiting slot and the elastic member, the rotating member can have an elastic space during motion. This ensures the smoothness of the motion of the rotating member, so that the bubble machine blows out bubbles more stably, and the use experience of the bubble machine is enhanced.

In an embodiment, the fixing member further includes at least one first fastener connected to the ring wall structure; the bubble forming part is further provided with a second fastener; and the first fastener and the second fastener cooperate with each other to fix the fixing member and the bubble forming part. By the cooperation between the first fastener and the second fastener, the fixing member and the bubble forming part can be fixed. The mounting is convenient, and the connection is firm.

In an embodiment, the base plate includes a first central portion and at least one first peripheral portion connected to a periphery of the first central portion; the first central portion is provided with the liquid inlet penetrating through the first central portion; the liquid guide slot is provided on surfaces of sides, close to the liquid storage member, of the first central portion and the at least one first peripheral portion; the liquid storage member includes a second central portion and at least one second peripheral portion adjacent to a periphery of the second central portion; the second central portion is provided with the liquid outlet penetrating through the second central portion; the second central portion corresponds to the first central portion; and the at least one second peripheral portion corresponds to the at least one first peripheral portion.

In an embodiment, a quantity of the at least one first peripheral portion is plural, and the plurality of first peripheral portions are spaced apart in sequence; a quantity of the at least one second peripheral portion is plural, and the plurality of second peripheral portions are spaced apart in sequence and are in one-to-one correspondence to the plurality of first peripheral portions; and air of the fan is blown towards the bubble forming part through gaps between the plurality of partition plates, gaps between the plurality of first peripheral portions, and gaps between the plurality of second peripheral portions in sequence. By the arrangement of the first peripheral portions and the second peripheral portions, the liquid guide slot can be closed, making it difficult for the bubble liquid to flow out, and the bubble liquid can accurately flow towards the liquid outlet. Meanwhile, the gaps between the plurality of first peripheral portions and the plurality of second peripheral portions can blow the air blown by the fan towards the bubble forming part, so that the bubble machine blows out bubbles more stably, and the use experience of the bubble machine is enhanced.

In an embodiment, the liquid guide slot includes a plurality of liquid guide sub-slots communicating with the liquid inlet; each liquid guide sub-slot extends from the liquid inlet towards one of the first peripheral portions; the liquid storage member is further provided with a liquid inlet slot arranged on surfaces of sides, close to the rotating member, of the second central portion and the plurality of second peripheral portions; and the liquid storage member abuts against the base plate, so that the liquid inlet slot communicates with the various the liquid guide sub-slots. By the arrangement of the liquid guide sub-slots and the liquid inlet slot, the bubble liquid can be guided to accurately flow towards the liquid outlet and not easily flow out of the motion and liquid introduction member, so that the bubble machine blows out bubbles more stably, and the use experience of the bubble machine is enhanced.

In an embodiment, the first central portion and the plurality of first peripheral portions further form a boss structure; the various liquid guide sub-slots are arranged on the boss structure; a shape of the boss structure is adapted to the liquid inlet slot, so that the boss structure is arranged in the liquid inlet slot; a top surface and side surface of the boss structure are in contact with a bottom wall and side wall of the liquid inlet slot; the liquid storage member is further provided with a liquid outlet slot arranged on surfaces of sides, close to the bubble forming part, of the plurality of second peripheral portions; the bubble forming units include enclosure wall structures with bubble outlets; the plurality of bubble forming units are annularly arranged at intervals; the bubble forming part further includes a mounting portion annularly arranged at peripheries of the plurality of bubble forming units, and connectors connected between the mounting portion and the bubble forming units; and the mounting portion is connected to the shell main body to fix the bubble forming part on the shell. By the arrangement of the liquid outlet slot, the bubble liquid can be accurately introduced into the bubble forming units. The plurality of bubble forming units are annularly arranged at intervals, which can generate a plurality of bubbles simultaneously, so that the use experience of the bubble machine is enhanced.

In an embodiment, the bubble machine further includes a liquid guide member; the liquid outlet member communicates between the liquid inlet and the liquid guide member; one end of the liquid guide member away from the liquid outlet member is configured to obtain the bubble liquid from a bubble liquid tank; and the liquid guide member is further connected to the gear module, so that when the gear module moves under the driving of the driving device, the gear module applies a driving force to the liquid guide member, and then the liquid guide member generates a suction force to suck the bubble liquid from the bubble liquid tank. By the arrangement of the liquid guide member, the bubble liquid in the bubble liquid tank can be introduced into the liquid outlet member. Meanwhile, the gear module applies the driving force to the liquid guide member when moving under the driving of the driving device, and then the liquid guide member generates the suction force to suck the bubble liquid from the bubble liquid tank. This not only ensures that the liquid guide member sucks the bubble liquid stably, but also uses the driving force generated by the gear module, without the need for an additional element, thereby saving the production costs and making the structure of the bubble machine more compact.

In an embodiment, the gear module includes a first gear, a second gear, and at least one third gear; the first gear, the second gear, and the at least one third gear are all mounted on the shell main body through a mounting shaft; the first gear is engaged with the transmission thread; the second gear is engaged with the first gear; the liquid guide member includes a conveying tube made of a flexible material; the liquid guide member is at least sandwiched between a gear surface on one side of the second gear and an inner surface of the shell main body, so that when the second gear rotates, the liquid guide member generates a suction force to suck the bubble liquid from the bubble liquid tank; and the at least one third gear is engaged with the first gear and the first transmission tooth, respectively.

In an embodiment, the at least one third gear includes two third gears; one third gear is engaged with the first gear and the other third gear, respectively, and the other third gear is engaged with the first transmission tooth; the output shaft rotates around a first preset axial direction; the first gear, the second gear, and at least one third gear all rotate around a second preset axial direction; the first preset axial direction is perpendicular to the second preset axial direction; and when the at least one third gear rotates around the second preset axial direction, the first transmission tooth causes the transmission member to rotate around the first preset axial direction, thereby driving the motion and liquid introduction member to rotate around the first preset axial direction.

In an embodiment, the transmission member includes a panel provided with the first transmission tooth, a transmission shaft connected to the panel, and a fourth gear connected to the transmission shaft and the third transmission tooth; the transmission shaft extends in the first preset axial direction; the first transmission tooth includes a plurality of annularly arranged teeth arranged on one side surface of the panel; and the plurality of teeth are engaged with the at least one third gear.

In an embodiment, the bubble machine further includes a swing rod; the swing rod includes a connecting portion and a swing portion connected to the connecting portion in a bent manner; one end of the connecting portion is connected to the motion and liquid introduction member, and the other end passes through the bubble forming part; and the swing portion is located on one side of the bubble forming part away from the motion and liquid introduction member, and is configured to be driven, when the motion and liquid introduction member moves, by the motion and liquid introduction member to swing, so as to push the bubbles generated by the bubble forming units to be separated from the bubble machine. By the arrangement of the swing rod, after the bubble forming units generate bubbles, the swing rod can immediately scrape the bubbles away from the bubble forming units, so that the bubble forming units can continue to generate a next round of bubbles, thereby ensuring that the bubble machine stably outputs bubbles and enhancing the use experience of the bubble machine.

In an embodiment, the bubble machine further includes a backflow member; the backflow member is mounted on the shell and corresponds to a bottom of at least one of the bubble forming part and the motion and liquid introduction member; and the backflow member is configured to: receive leaking liquid from at least one of the bubble forming part and the motion and liquid introduction member and introduce the leaking liquid into the bubble liquid tank through a backflow tube. By the arrangement of the backflow member, the leaking liquid of at least one of the bubble forming part and the motion and liquid introduction member can be collected and can be introduced into the bubble liquid tank, so that the bubble liquid is used more efficiently and is prevented from flowing out of the bubble machine, and the use experience of the bubble machine is enhanced.

In an embodiment, the bubble machine further includes a control switch, a circuit board, and a power supply; the circuit board is electrically connected to the control switch, the power supply, and the driving device; and when the control switch is operated, the circuit board generates a triggering signal and controls the driving device to work to:

drive the fan to rotate and drive the motion and liquid introduction member to move through the driving device.

BRIEF DESCRIPTION OF THE DRAWINGS

To describe the technical solutions in the embodiments of the present disclosure or in the related art more clearly, the following briefly introduces the accompanying drawings for describing the embodiments or the related art. Apparently, the accompanying drawings in the following description show merely the embodiments of the present disclosure, and a person of ordinary skill in the art may still derive other drawings from the provided accompanying drawings without creative efforts.

DETAILED DESCRIPTION OF THE EMBODIMENTS

Figure 1:
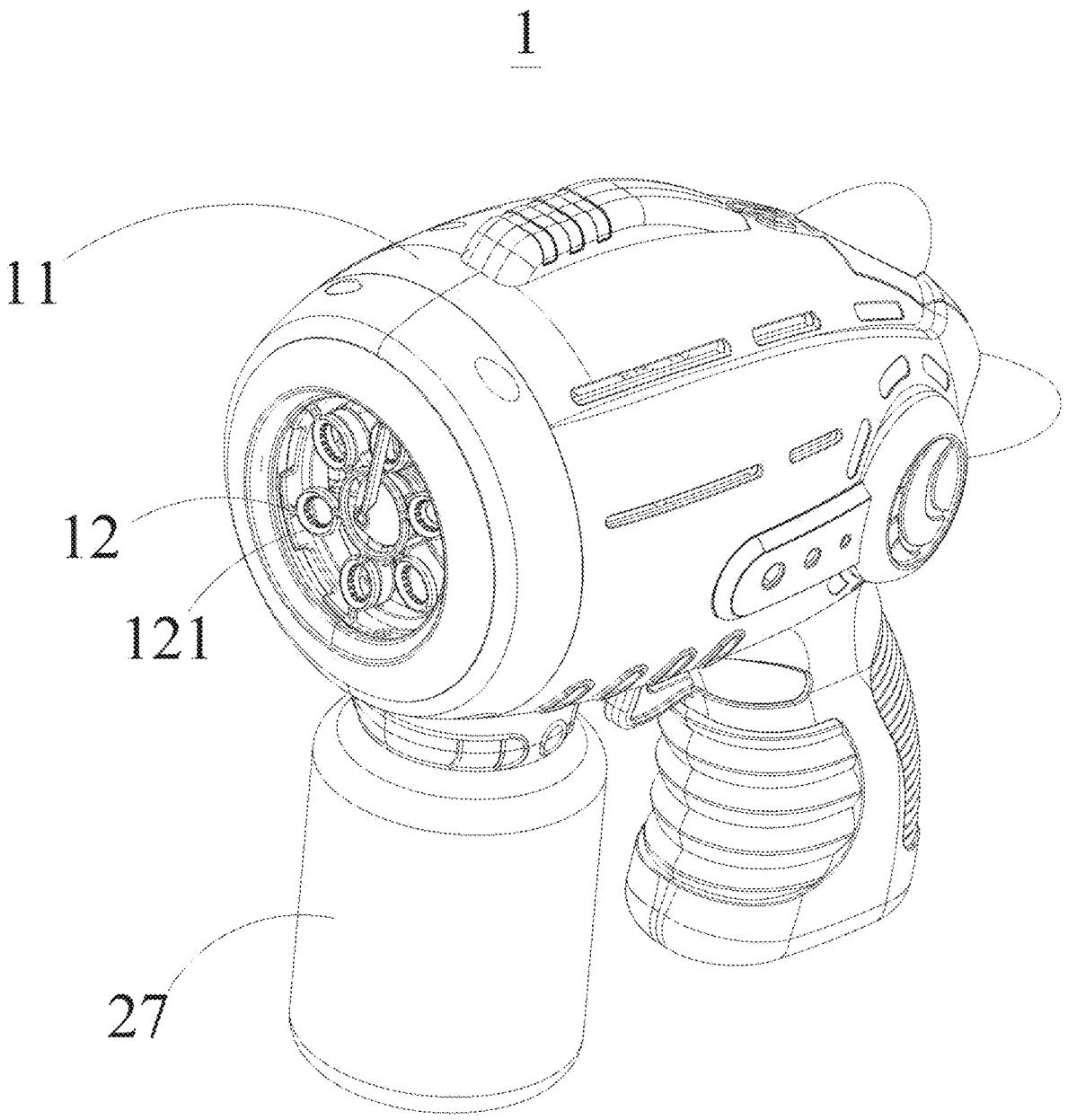
FIG. 1 is a three-dimensional diagram of a bubble machine disclosed by an embodiment of the present disclosure.
Figure 2:
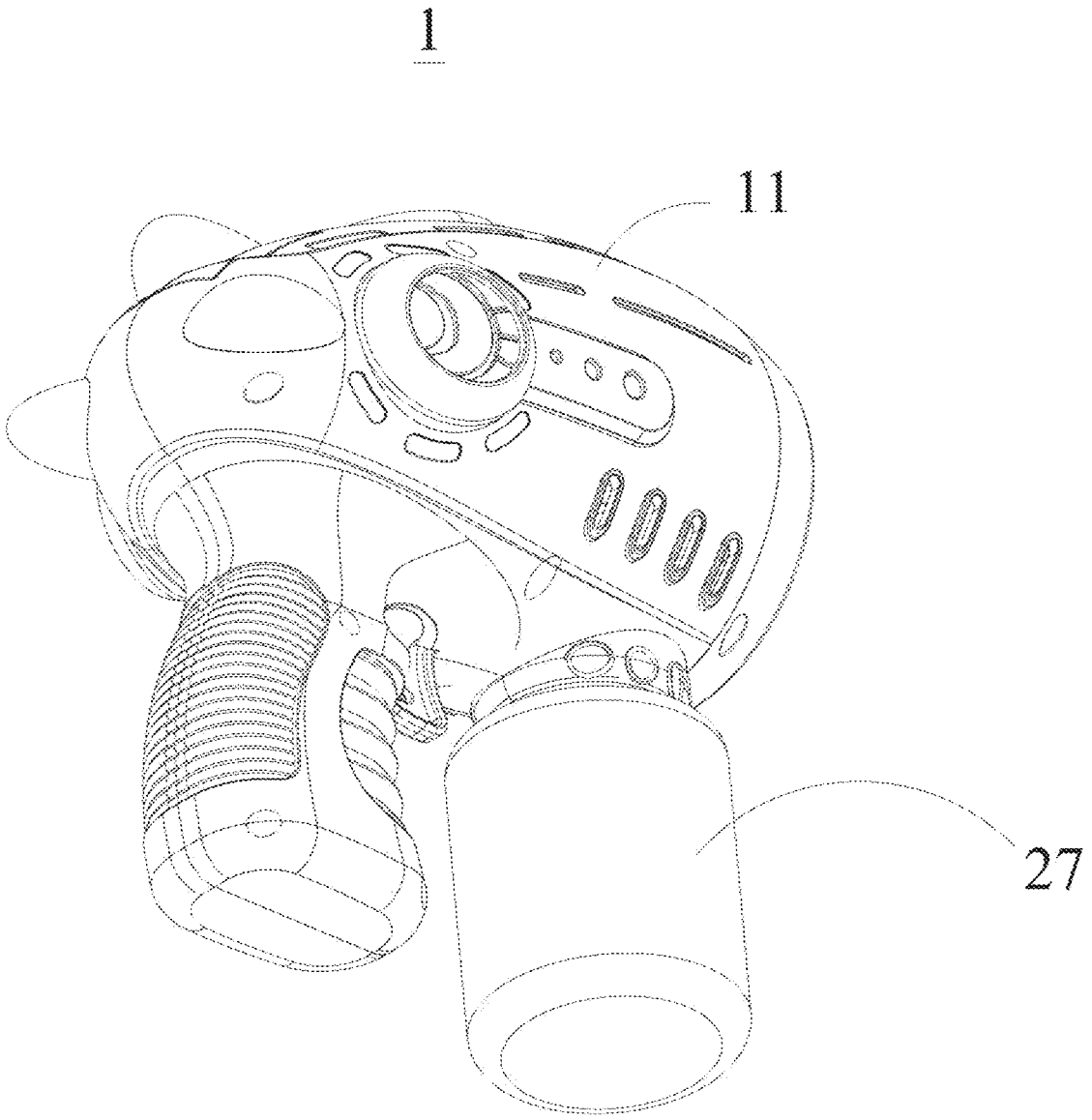
FIG. 2 is a three-dimensional diagram of the bubble machine shown in FIG. 1 in another angle.

In order to facilitate understanding the present disclosure, the present disclosure will be described more comprehensively below with reference to related accompanying drawings. Preferred implementations of the present disclosure are provided in the drawings. However, the present disclosure can be implemented in many different forms, and are not limited to the implementations described herein. On the contrary, these implementations are provided to make the content disclosed in the present disclosure understood more thoroughly and comprehensively.

It should be noted that when an element is referred to as being "fixed to" another element, the element can be directly on another component or there can be a centered element. When an element is considered to be "connected" to another element, the element can be directly connected to another element or there may be a centered element. The terms "inner", "outer", "left", "right", and similar expressions used herein are for illustrative purposes only and do not necessarily represent the only implementation.

Unless otherwise defined, all technical and scientific terms used herein have the same meaning as those commonly understood by a person skilled in the art to which the present disclosure belongs. Terms used in the specification of the present disclosure herein are merely intended to describe objectives of the specific embodiments, but are not intended to limit the present disclosure. The term "and/or" used herein includes any and all combinations of one or more related listed items.

Referring to FIG. 1 to FIG. 6, the embodiments of the present disclosure provide a bubble machine 1. The bubble machine 1 includes a shell 11, a bubble forming part 12, and a motion and liquid introduction member 122. The bubble forming part 12 is arranged on the shell 11 and is provided with a plurality of bubble forming units 121; the motion and liquid introduction member 122 is arranged on the shell 11 and is provided with a liquid inlet 1221 and a liquid outlet 1222; the liquid inlet 1221 is configured to obtain bubble liquid and introduce the bubble liquid into the liquid outlet 1222; the liquid outlet 1222 is arranged in a manner of corresponding to the bubble forming part 12; and the motion and liquid introduction member 122 is configured to be driven to move to introduce the bubble liquid at the liquid outlet 1222 into the plurality of bubble forming units 121, so that the plurality of bubble forming units 121 can generate a plurality of bubbles using the introduced bubble liquid when there is an air flow motion in a preset direction. It can be understood that in this embodiment, the motion and liquid introduction member 122 can move under the driving of the external force. The driving of the external force can be manual driving of a user, mechanical driving, and the like. The bubble forming part 12 is provided with the plurality of bubble forming units 121, so that when the motion and liquid introduction member 122 moves under the driving of the external force, the bubble liquid can be introduced into the different bubble forming units 121. Namely, the bubble liquid flows from the liquid inlet 1221 of the motion and liquid introduction member 122 towards the liquid outlet 1222. The motion and liquid introduction member 122 moves under the driving of the external force to introduce the bubble liquid from the liquid outlet 1222 into the different bubble forming units 121, so that the bubble forming units 121 can generate a plurality of bubbles using the introduced bubble liquid when there is an air flow motion in the preset direction. The air flow in the preset direction can be an air flow blown by a user to the bubble machine 1, or can be an air flow generated by another element (such as a fan).

In the bubble machine 1 provided in the embodiments of the present disclosure, by the arrangement of the motion and liquid introduction member 122, when the motion and liquid introduction member 122 is driven to move, the bubble liquid at the liquid outlet 1222 is introduced into the plurality of bubble forming units 121, so that the plurality of bubble forming units 121 can generate a plurality of bubbles using the introduced bubble liquid when there is an air flow motion in the preset direction. In the process of generating the bubbles, the bubble forming part 12 does not need to move, and the motion and liquid introduction member 122 conveys the bubble liquid to the plurality of bubble forming units 121 through the motion, which can effectively avoid breakage of the formed bubbles, make the output of bubbles more stable, and enhance the use experience of the bubble machine 1.

Further, the bubble machine 1 further includes a fan 13, a transmission device 14, and a driving device 15; the fan 13 is configured to blow air towards the plurality of bubble forming units 121 to generate the air flow motion in the preset direction; the transmission device 14 is connected to the motion and liquid introduction member 122; and the driving device 15 is connected to the fan 13 and the transmission device 14 and is configured to: drive the fan 13 to rotate to generate the air flow motion in the preset direction, and drive the motion and liquid introduction member 122 to move through the transmission device 14. By the arrangement of the transmission device 14, the driving device 15 can drive the motion and liquid introduction member 122 to move through the transmission device when driving the fan 13, so that the structure of the bubble machine 1 is more compact, and the production costs can be saved.

Specifically, the driving device 15 includes a driving main body 151 and an output shaft 152 connected to the driving main body 151; the output shaft 152 is connected to the fan 13 and the transmission device 14; the output shaft 152 is provided with a transmission thread 153; the transmission device 14 includes a gear module 141 and a transmission member 142; the transmission member 142 is provided with a first transmission tooth 1421 and a second transmission tooth 1425; the motion and liquid introduction member 122 is provided with a third transmission tooth 1223; the gear module 141 includes at least one gear; the gear module 141 is in meshing connection with the transmission thread 153 and the first transmission tooth 1421; the second transmission tooth 1425 is in meshing connection with the third transmission tooth 1223; when the driving main body 151 drives the output shaft 152 to rotate, the fan 13 rotates to blow air, and the transmission thread 153 drives the gear module 141 to move; and the gear module 141 drives the transmission member 142 to move through the first transmission tooth 1421, so that the second transmission tooth 1425 drives the motion and liquid introduction member 122 to move. It can be understood that when a user uses the bubble machine 1 to blow bubbles, the driving device 15 drives the output shaft 152 to rotate, thus making the transmission thread 153 to rotate. The transmission thread 153 is in meshing connection with the gear module 141, so that the gear module 141 is driven to rotate. The gear module 141 drives the first transmission tooth 1421 to rotate through the meshing connection. At this time, the second transmission tooth 1425 and the first transmission tool 1421 synchronously rotate, and the second transmission tooth 1425 then drives the third transmission tooth 1223 to rotate through the meshing connection, thus driving the motion and liquid introduction member 122 to move. By the arrangement of the output shaft 152 provided with the transmission thread 153, the gear module 141, and the transmission member 142, the gear module 141 is in meshing connection with the transmission thread 153 and the first transmission tooth 1421; the second transmission tooth 1425 is in meshing connection with the third transmission tooth 1223; when the driving main body 151 drives the output shaft 152 to rotate, the fan 13 can be driven to rotate to blow air; meanwhile, the transmission thread 153 drives the gear module 141 to move; and the gear module 141 drives the transmission member 142 to move through the first transmission tooth 1421, so that the second transmission tooth 1425 drives the motion and liquid introduction member 122 to move, thus generating and blowing out bubbles. The whole process is stable and smooth in transmission, and stable outputting of the bubbles is ensured. Moreover, gears are engaged with the driving device 15 to simultaneously drive the fan 13 and the transmission device 14. The bubble machine is compact in structure and stable in working state, and the use experience of the bubble machine 1 is enhanced. It can be understood that the driving motor 15 can be a motor. The driving main body 151 is a motor main body. The output shaft 152 is an output shaft of the motor. The transmission thread is arranged on the output shaft 152.

Further, the shell i11 can include a shell main body 111 and a fixing member 112; the shell main body 111 is provided with a mounting port 1111; the fixing member 112 is arranged in a manner of corresponding to the mounting port 1111; the fixing member 112 is provided with a mounting hole 1121; the bubble machine 1 further includes a liquid outlet member 16 configured to obtain the bubble liquid; the liquid outlet member 16 is mounted in the mounting hole 1121; the motion and liquid introduction member 122 includes a rotating member 123 and a liquid storage member 1224; the rotating member 123 includes a base plate 1231 provided with the liquid inlet 1221 and a liquid guide slot 1225 communicating with the liquid inlet 1221, an annularly arranged extending plate 1232 corresponding to the liquid inlet 1221 and extending from one side of the base plate 1231 towards the mounting hole 1121, and a ringlike structure connected to and annularly arranged at an outer edge of the base plate 1231; the ringlike structure is provided with the third transmission tooth 1223; the extending plate 1232 is connected to the motion and liquid introduction member 122 to communicate the liquid inlet 1221 with the liquid outlet member 16; the liquid storage member 1224 is arranged on one side of the base plate 1231 away from the extending plate 1232 and is provided with the liquid outlet 1222; and the liquid outlet 1222 communicates with the liquid guide slot 1225. It can be understood that the liquid outlet member 16 can be a flexible material, such as silica gel. The rotating member 123 can be a plastic material. The liquid storage member 1224 can be a flexible material too, such as silica gel.

By the arrangement of the liquid outlet member 16, the rotating member 123, and the liquid storage member 1224, the bubble liquid can flow into the liquid inlet 1221 through the liquid outlet member 16, and be introduced into the liquid outlet 1222 through the liquid guide slot 1225, so that the bubble liquid can accurately flow to the liquid outlet 1222 through the liquid inlet 1221, avoiding leakage of the bubble liquid and ensuring the stability of the bubble machine 1 blowing out bubbles, and enhancing the use experience of the bubble machine 1.

Figure 7:
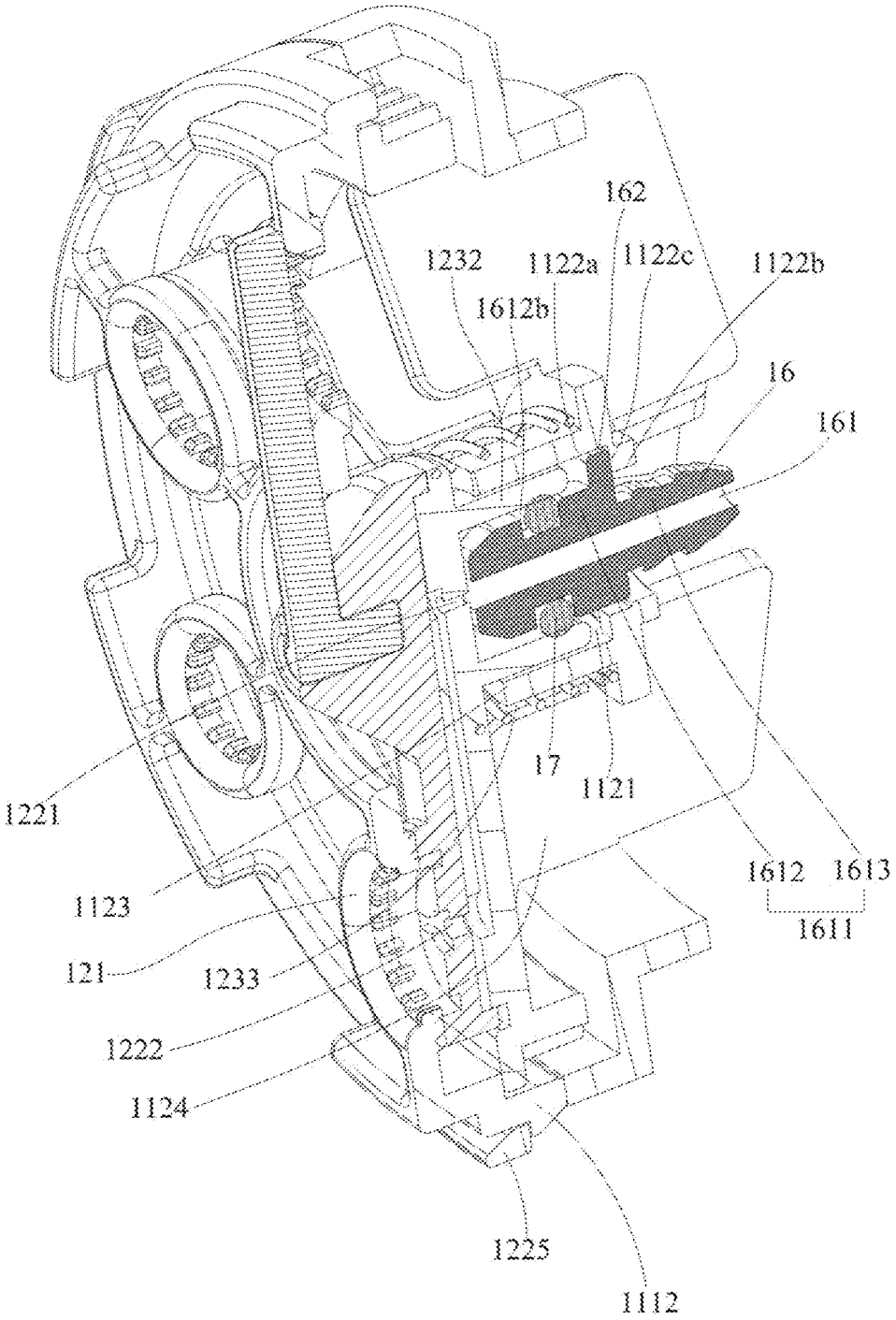
FIG. 7 is a partially sectional diagram of the bubble machine shown FIG. 1.

Further, as shown in FIG. 7, an inner wall of the mounting hole 1121 includes a first portion 1122*a*, a second portion 1122*b*, and a connecting portion 1122*c* connected between the first portion 1122*a* and the second portion 1122*b*; the liquid outlet member 16 includes a tube body 1611 provided with a liquid channel 161, and a fixed flange 162 arranged at a periphery of the tube body 1611; the tube body 1611 is divided by the fixed flange 162 into a first tube portion 1612 close to the rotating member 123 and a second tube portion 1613 far from the rotating member 123; the liquid channel 161 penetrates through the first tube portion 1612 and the second tube portion 1613; the first tube portion 1612 and the fixed flange 162 are located in the first portion 1122*a*; the extending plate 1232 extends into the first portion 1122*a* and is located between the first portion 1122*a* and the first tube portion 1612; the liquid inlet 1221 corresponds to the liquid channel 161 of the first tube portion 1612; the fixed flange 162 is in contact with the connecting portion 1122*c*; and the second tube portion 1613 is at least partially located in the second portion 1122*b*. Since the first tube portion 1612 and the fixed flange 162 are arranged in the first portion 1122*a*, the extending plate 1232 extends into the first portion 1122*a* and is located between the first portion 1122*a* and the first tube portion 1612; the liquid inlet 1221 corresponds to the liquid channel 161 of the first tube portion 1612, so that the liquid outlet member 16, the rotating member 123, and the fixing member 112 can be fixedly mounted, and it ensures that the rotating member 123 can stably obtain the bubble liquid flowing out of the liquid outlet member 16 during the motion, thereby ensuring the stability of the bubble machine 1 blowing bubbles and enhancing the use experience of the bubble machine 1.

Further, the bubble machine 1 further includes a sealing ring 17; the sealing ring 17 can be a flexible material, such as a silica gel material; the sealing ring 17 sleeves an outer surface of the first tube portion 1612 and abuts between the extending plate 1232 and the first tube portion 1612; and the outer surface of the first tube section 1612 is provided with a fixing groove 1612*b*; and the sealing ring 17 is at least partially embedded in the fixing groove 1612*b*. It can be understood that in this embodiment, the first portion 1122*a* and the connecting portion 1122*c* of the mounting hole 1121 form a step structure; and the fixed flange 162 can be clamped with the step structure formed by the first portion 1122*a* and the connecting portion 1122*c*, so that the liquid outlet member 16 is clamped and fixed in the mounting hole 1121. By the arrangement of the sealing ring 17, the first tube portion 1612 can be tightly connected to the extending plate 1232 to prevent the bubble liquid from flowing out, and the safety of use of the bubble machine 1 is ensured.

Further, the fixing member 112 includes an enclosing portion 1123 enclosed to form the mounting hole 1121, a plurality of partition plates 1124 connected to a periphery of the enclosing portion 1123 and spaced apart, and a ring wall structure annularly arranged at and connected to outer edges of the plurality of partition plates 1124; the ring wall structure is mounted on an inner wall of the shell main body 111; and air of the fan 13 is blown towards the bubble forming part 12 through gaps between the plurality of partition plates 1124. By the arrangement of the enclosing portion 1123, the partition plates 1124 of the enclosing portion 1123 can not only play a role of strengthening and fixing, but also play a role of guiding air of the fan 13, so that the bubble machine 1 blows out bubbles more stably, and the use experience of the bubble machine 1 is enhanced.

Further, a limiting slot 1233 adjacent to the rotating member 123 is further enclosed between the enclosing portion 1123 and the partition plates 1124; the bubble machine 1 further includes an elastic member 18; the elastic member 18 is located in the limiting slot 1233 and abuts between the rotating member 123 and the fixing member 112; and the elastic member 18 is a spring sleeving the periphery of the enclosing portion 1123. By the arrangement of the limiting slot 1233 and the elastic member 18, the rotating member 123 can have an elastic space during motion. This ensures the smoothness of the motion of the rotating member 123, so that the bubble machine 1 blows out bubbles more stably, and the use experience of the bubble machine 1 is enhanced.

Further, the fixing member 112 further includes at least one first fastener 1125 connected to the ring wall structure; the bubble forming part 12 is further provided with a second fastener 1112; and the first fastener 1125 and the second fastener 1112 cooperate with each other to fix the fixing member 112 and the bubble forming part 12. By the cooperation between the first fastener 1125 and the second fastener 1112, the fixing member 112 and the bubble forming part 12 can be fixed. The mounting is convenient, and the connection is firm.

Figure 4:
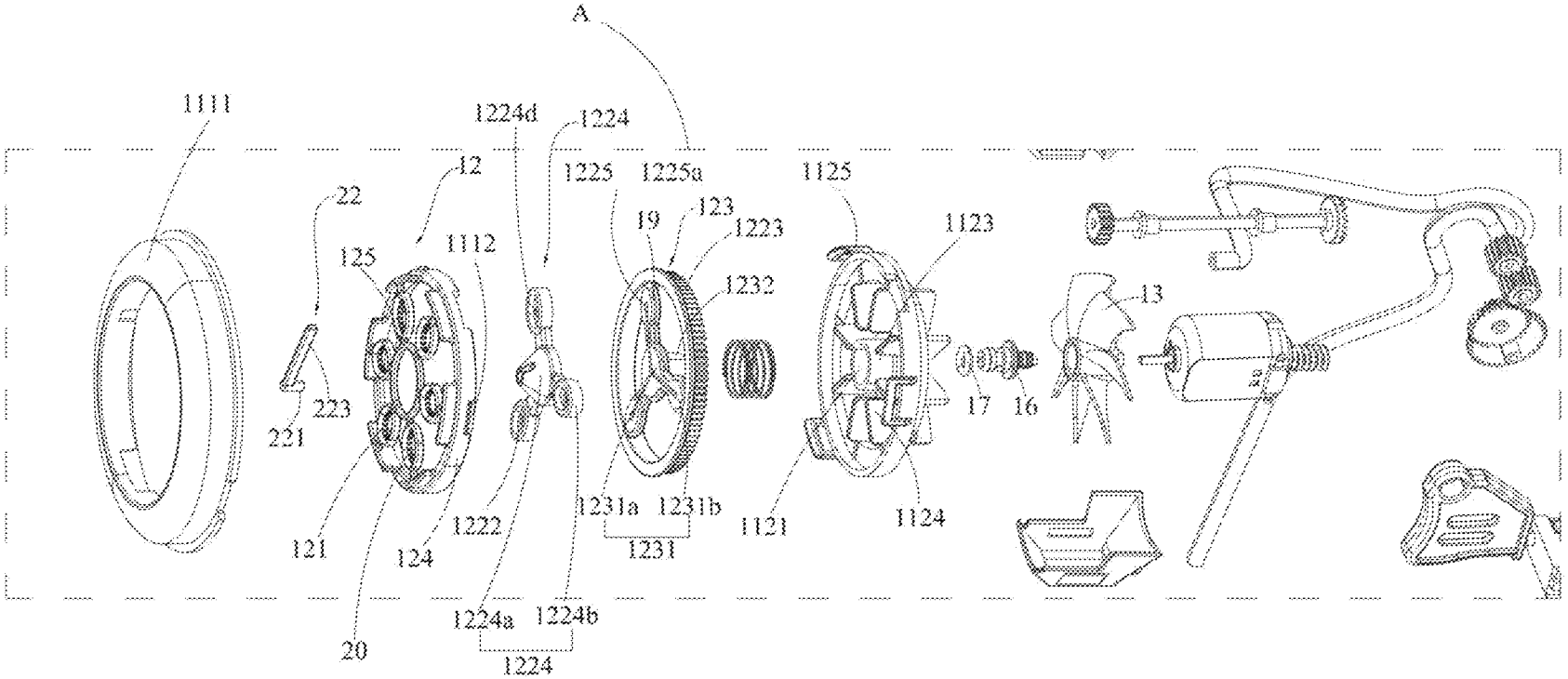
FIG. 4 is an enlarged view of part A of FIG. 3.
Figure 5:
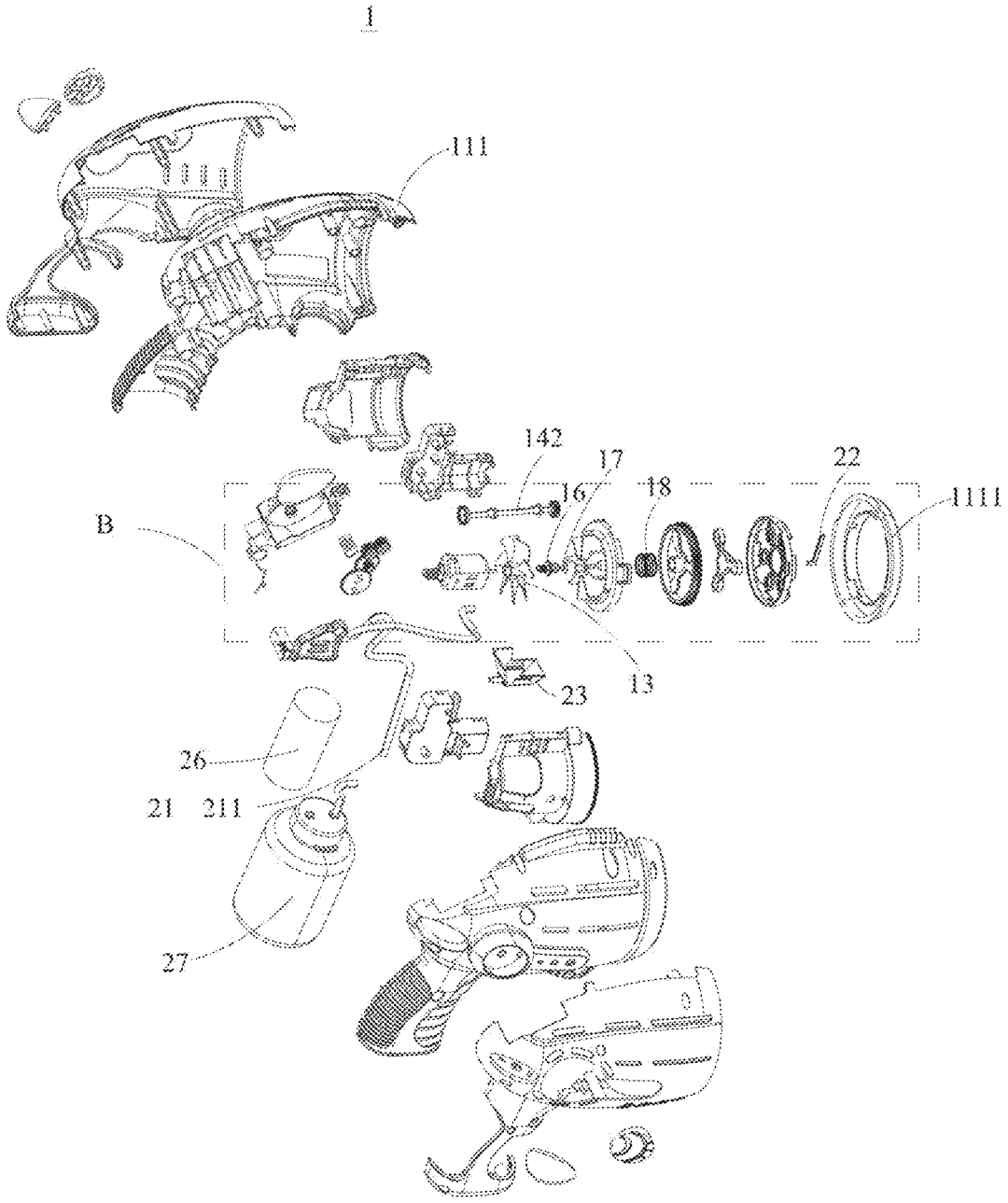
FIG. 5 is an exploded diagram of the bubble machine shown in FIG. 1 in another angle.
Figure 6:
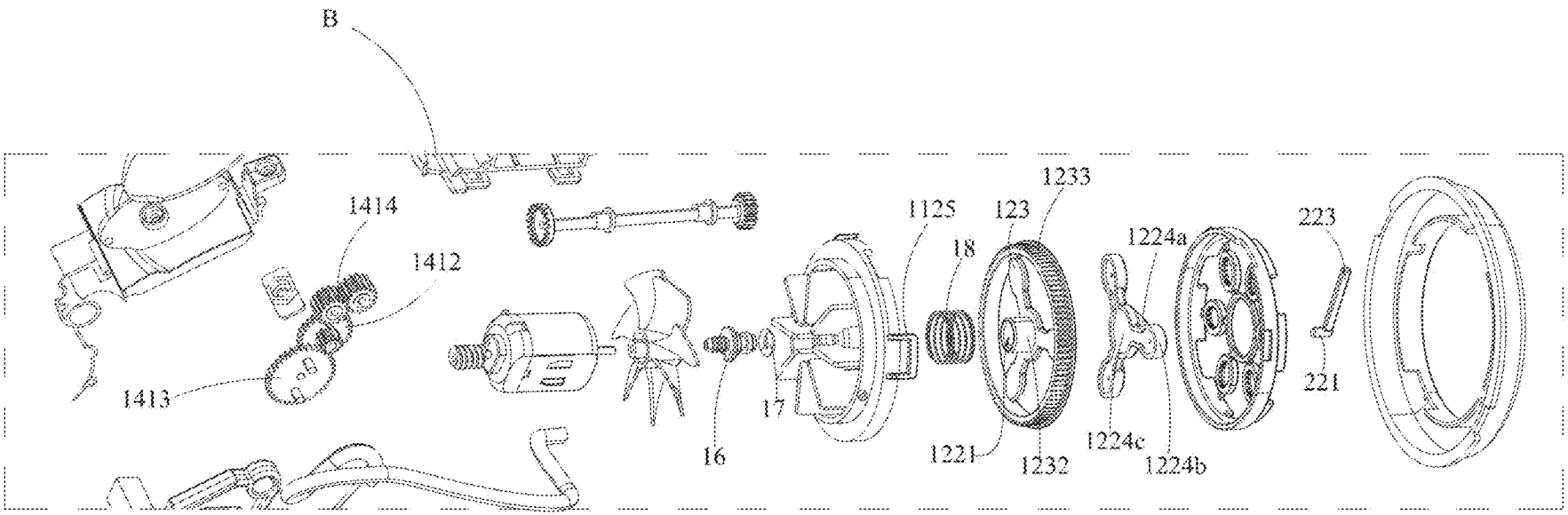
FIG. 6 is an enlarged view of part B of FIG. 5.

Further, as shown in FIG. 4 and FIG. 6, the base plate 1231 includes a first central portion 1231*a* and at least one first peripheral portion 1231*b* connected to a periphery of the first central portion 1231*a*; the first central portion 1231*a* is provided with the liquid inlet 1221 penetrating through the first central portion; the liquid guide slot 1225 is provided on surfaces of sides, close to the liquid storage member 1224, of the first central portion 1231*a* and the at least one first peripheral portion 1231*b*; the liquid storage member 1224 includes a second central portion 1224*a* and at least one second peripheral portion 1224*b* adjacent to a periphery of the second central portion 1224*a*; the second central portion 1224*a* is provided with the liquid outlet 1222 penetrating through the second central portion; the second central portion 1224*a* corresponds to the first central portion 1231*a*; and the at least one second peripheral portion 1224*b* corresponds to the at least one first peripheral portion 1231*b*.

Further, in this embodiment, a quantity of the at least one first peripheral portion 1231*b* is plural, and the plurality of first peripheral portions 1231*b* are spaced apart in sequence; a quantity of the at least one second peripheral portion 1224*b* is plural, and the plurality of second peripheral portions 1224*b* are spaced apart in sequence and are in one-to-one correspondence to the plurality of first peripheral portions 1231*b*; and air of the fan 13 is blown towards the bubble forming part 12 through gaps between the plurality of partition plates 1124, gaps between the plurality of first peripheral portions 1231*b*, and gaps between the plurality of second peripheral portions 1224*b* in sequence. By the arrangement of the first peripheral portions 1231*b* and the second peripheral portions 1224*b*, the liquid guide slot 1225 can be closed, making it difficult for the bubble liquid to flow out, and the bubble liquid can accurately flow towards the liquid outlet 1222. Meanwhile, the gaps between the plurality of first peripheral portions 1231*b* and the plurality of second peripheral portions 1224*b* can blow the air blown by the fan 13 towards the bubble forming part 12, so that the bubble machine 1 blows out bubbles more stably, and the use experience of the bubble machine 1 is enhanced.

Further, as shown in FIG. 4 and FIG. 6, in this embodiment, the liquid guide slot 1225 includes a plurality of liquid guide sub-slots 1225*b* communicating with the liquid inlet 1221; each liquid guide sub-slot 1225*a* extends from the liquid inlet 1221 towards one of the first peripheral portions 1231*b*; the liquid storage member 1224 is further provided with a liquid inlet slot 1224*c* arranged on surfaces of sides, close to the rotating member 123, of the second central portion 1224*a* and the plurality of second peripheral portions 1224*b*; and the liquid storage member 1224 abuts against the base plate 1231, so that the liquid inlet slot 1224*c* communicates with the various the liquid guide sub-slots 1225*a*. By the arrangement of the liquid guide sub-slots 1225*a* and the liquid inlet slot 1224*c*, the bubble liquid can be guided to accurately flow towards the liquid outlet 1222 and not easily flow out of the motion and liquid introduction member 122, so that the bubble machine 1 blows out bubbles more stably, and the use experience of the bubble machine 1 is enhanced.

Further, the first central portion 1231*a* and the plurality of first peripheral portions 1231*b* further form a boss structure 19; the various liquid guide sub-slots 1225*a* are arranged on the boss structure 19; a shape of the boss structure 19 is adapted to the liquid inlet slot 1224*c*, so that the boss structure 19 is arranged in the liquid inlet slot 1224*c*; a top surface and side surface of the boss structure 19 are in contact with a bottom wall and side wall of the liquid inlet slot 1224*c*; the liquid storage member 1224 is further provided with a liquid outlet slot 1224*d* arranged on surfaces of sides, close to the bubble forming part 12, of the plurality of second peripheral portions 1224*b*; the bubble forming units 121 include enclosure wall structures 20 with bubble outlets; the plurality of bubble forming units 121 are annularly arranged at intervals; the bubble forming part 12 further includes a mounting portion 124 annularly arranged at peripheries of the plurality of bubble forming units 121, and connectors 125 connected between the mounting portion 124 and the bubble forming units 121; and the mounting portion 124 is connected to the shell main body 111 to fix the bubble forming part 12 on the shell 11. It can be understood that in this embodiment, the enclosure wall structures 20 with the bubble outlet are of tooth-shaped structures, which can better suck the bubble liquid. By the arrangement of the liquid outlet slot 1224*d*, the bubble liquid can be accurately introduced into the bubble forming units 121. The plurality of bubble forming units 121 are annularly arranged at intervals, which can generate a plurality of bubbles simultaneously, so that the use experience of the bubble machine 1 is enhanced.

Further, the bubble machine 1 further includes a liquid guide member 21; the liquid outlet member 16 communicates between the liquid inlet 1221 and the liquid guide member 21; one end of the liquid guide member 21 away from the liquid outlet member 16 is configured to obtain the bubble liquid from a bubble liquid tank 27; and the liquid guide member 21 is further connected to the gear module 141, so that when the gear module 141 moves under the driving of the driving device 15, the gear module applies a driving force to the liquid guide member 21, and then the liquid guide member 21 generates a suction force to suck the bubble liquid from the bubble liquid tank 27. By the arrangement of the liquid guide member 21, the bubble liquid in the bubble liquid tank 27 can be introduced into the liquid outlet member 16. Meanwhile, the gear module 141 applies the driving force to the liquid guide member 21 when moving under the driving of the driving device 15, and then the liquid guide member 21 generates the suction force to suck the bubble liquid from the bubble liquid tank 27. This not only ensures that the liquid guide member 21 sucks the bubble liquid stably, and but also uses the driving force generated by the gear module 141, without the need for an additional element, thereby saving the production costs and making the structure of the bubble machine 1 more compact.

Figure 8:
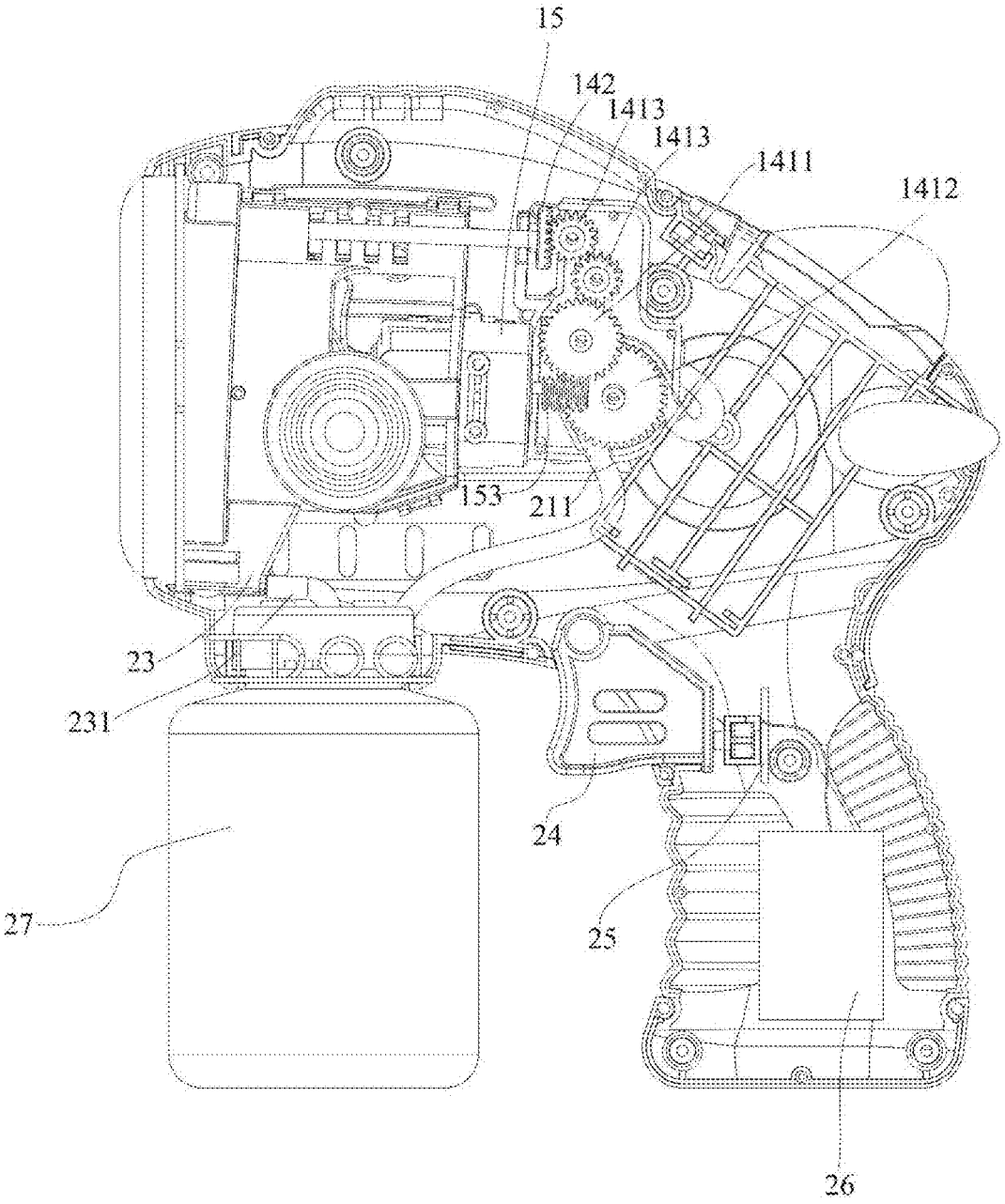
FIG. 8 is a three-dimensional diagram of removing a portion of a shell from the bubble machine shown in FIG. 1.

Further, as shown in FIG. 8, the gear module 141 includes a first gear 1412, a second gear 1413, and at least one third gear 1414; the first gear 1412, the second gear 1413, and the at least one third gear 1414 are all mounted on the shell main body 111 through a mounting shaft; the first gear 1412 is engaged with the transmission thread; the second gear 1413 is engaged with the first gear 1412; the liquid guide member 21 includes a conveying tube 211 made of a flexible material; the liquid guide member 21 is at least sandwiched between a gear surface on one side of the second gear 1413 and an inner surface of the shell main body 111, so that when the second gear 1413 rotates, the liquid guide member 21 generates a suction force to suck the bubble liquid from the bubble liquid tank 27; and the at least one third gear 1414 is engaged with the first gear 1412 and the first transmission tooth 1421, respectively.

Further, in this embodiment, the at least one third gear 1414 includes two third gears 1414; one third gear 1414 is engaged with the first gear 1412 and the other third gear 1414, respectively, and the other third gear 1414 is engaged with the first transmission tooth 1421; the output shaft 152 rotates around a first preset axial direction; the first gear 1412, the second gear 1413, and at least one third gear 1414 all rotate around a second preset axial direction; the first preset axial direction is perpendicular to the second preset axial direction; and when the at least one third gear 1414 rotates around the second preset axial direction, the first transmission tooth 1421 causes the transmission member 142 to rotate around the first preset axial direction, thereby driving the motion and liquid introduction member 122 to rotate around the first preset axial direction.

Further, the transmission member 142 includes a panel 1423 provided with the first transmission tooth 1421, a transmission shaft 1424 connected to the panel 1423, and a fourth gear connected to the transmission shaft 1424 and the third transmission tooth 1223; the fourth gear is provided with the second transmission tooth 1425; the transmission shaft 1424 extends in the first preset axial direction; the first transmission tooth 1421 includes a plurality of annularly arranged teeth arranged on one side surface of the panel 1423; and the plurality of teeth are engaged with the at least one third gear 1414.

Further, the bubble machine 1 further includes a swing rod 22; the swing rod 22 includes a connecting portion 221 and a swing portion 223 connected to the connecting portion 221 in a bent manner; one end of the connecting portion 221 is connected to the motion and liquid introduction member 122, and the other end passes through the bubble forming part 12; and the swing portion 223 is located on one side of the bubble forming part 12 away from the motion and liquid introduction member 122, and is configured to be driven, when the motion and liquid introduction member 122 moves, by the motion and liquid introduction member 122 to swing, so as to push the bubbles generated by the bubble forming units 121 to be separated from the bubble machine 1. By the arrangement of the swing rod 22, after the bubble forming units 121 generate bubbles, the swing rod can immediately scrape the bubbles away from the bubble forming units 121, so that the bubble forming units 121 can continue to generate a next round of bubbles, thereby ensuring that the bubble machine 1 stably outputs bubbles and enhancing the use experience of the bubble machine 1.

Further, the bubble machine 1 further includes a backflow member 23; the backflow member 23 is mounted on the shell 11 and corresponds to a bottom of at least one of the bubble forming part 12 and the motion and liquid introduction member 122; and the backflow member 23 is configured to: receive leaking liquid from at least one of the bubble forming part 12 and the motion and liquid introduction member 122 and introduce the leaking liquid into the bubble liquid tank 27 through a backflow tube 231. By the arrangement of the backflow member 23, the leaking liquid of at least one of the bubble forming part 12 and the motion and liquid introduction member 122 can be collected and can be introduced into the bubble liquid tank 27, so that the bubble liquid is used more efficiently and is prevented from flowing out of the bubble machine 1, and the use experience of the bubble machine 1 is enhanced.

Further, the bubble machine 1 further includes a control switch 24, a circuit board 25, and a power supply 26; the circuit board 25 is electrically connected to the control switch 24, the power supply 26, and the driving device 15; and when the control switch 24 is operated, the circuit board 25 generates a triggering signal and controls the driving device 15 to work to: drive the fan 13 to rotate and drive the motion and liquid introduction member 122 to move through the driving device 14.

Figure 3:
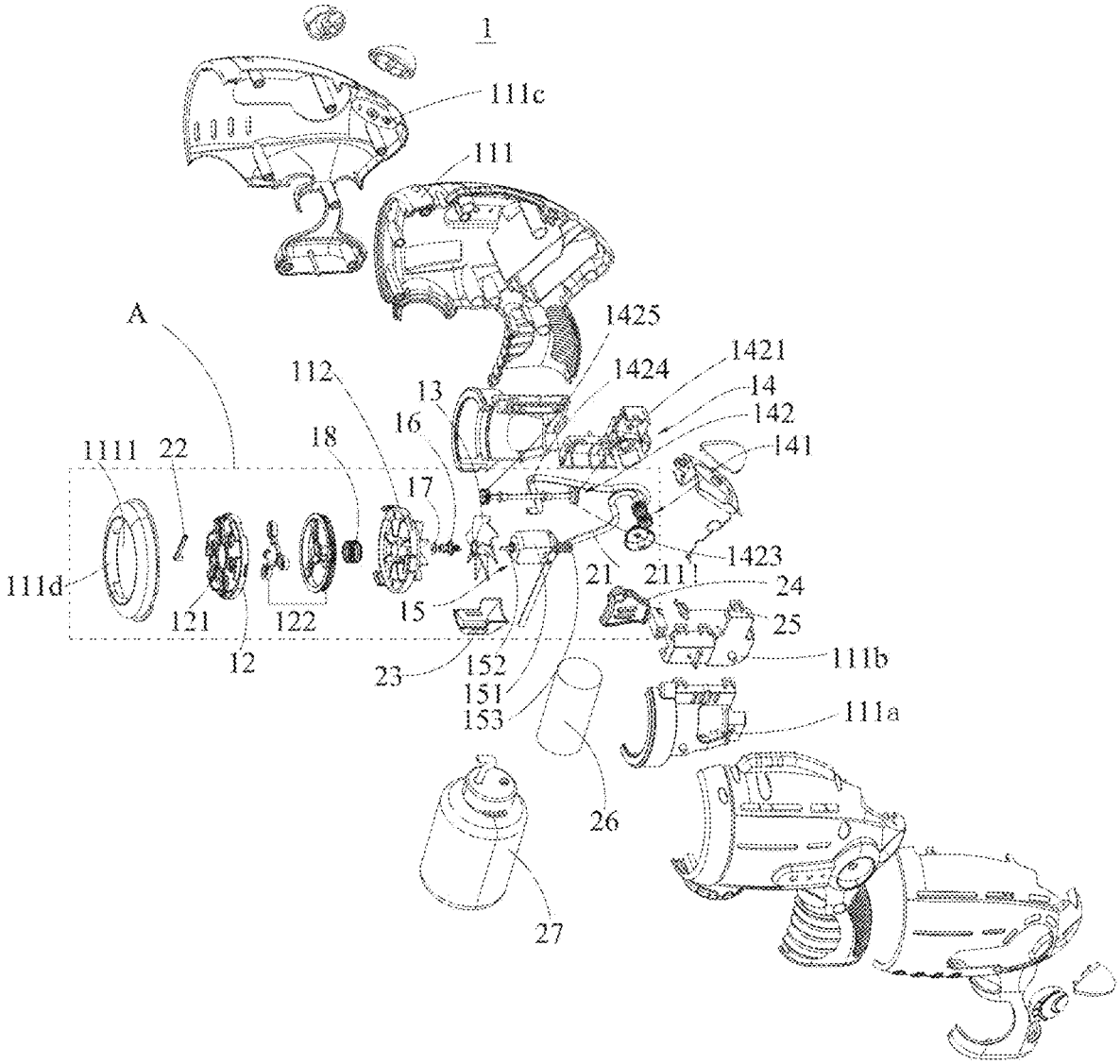
FIG. 3 is an exploded diagram of the bubble machine of FIG. 1.

It can be understood that as shown in FIG. 3, the shell main body 111 may include a plurality of portions, such as a first inner shell 111*a*, a second inner shell 111*b*, a shell assembly 111*c*, and a mounting member 111*d*. The first inner shell 111*a* can be configured to store and fix the bubble forming part 12, the motion and liquid introduction member 122, the fixing member 112, the transmission member 142, and the backflow member 23, and the like. The second inner shell 111*b* can be configured to fix the gear module 141. The mounting member 111*d* is arranged on an outer side of the bubble forming part 12, and is provided with the mounting port 1111. The shell assembly 111*c* is configured to: connect and fix the first inner shell 111*a*, the second inner shell 111*b*, the shell assembly 111*c*, the mounting member 111*d*, and the like, and to fix or store other elements.

In this embodiment, three first peripheral portions 1231*b* and three second peripheral portions 1224*b*, and the at least one third gear 1414 including two third gears 1414 are taken as an example to explain the process of generating bubbles by the bubble machine 1.

When a user uses the bubble machine 1, the circuit board 25 is triggered by pressing the control switch 24 to turn on the power supply 26. The power supply 26 supplies power to the driving device 15, so that the output shaft 152 of the driving device 15 rotates, thereby causing the transmission thread 153 to rotate. The transmission thread 153 is in meshing connection with one of the third gears 1414 of the gear module 141 to drive one of the third gears 1414 to rotate. One of the third gears 1414 drives the other third gear 1414 to rotate through the meshing connection, and the other third gear 1414 drives the second gear 1413 to rotate through the meshing connection. The second gear 1413 drives the first gear 1412 to rotate through the meshing connection, and the first gear 1412 drives the first transmission tooth 1421 to rotate through the meshing connection. At this time, the transmission shaft 1424 connected to the panel 1423 of the first transmission tooth 1421 is connected to the fourth gear and drives the fourth gear to rotate. At this time, the second transmission tooth 1225 of the fourth gear drives the third transmission tooth 1223 of the motion and liquid introduction member 122 to rotate through the meshing, thereby causing the motion and liquid introduction member 122 to rotate. Meanwhile, one of the third gears 1414 applies the driving force to the liquid guide member 21 by rotation, and then the liquid guide member 21 generates the suction force to suck the bubble liquid from the bubble liquid tank 27; the bubble liquid is introduced into the liquid outlet member 16 through the liquid guide member 21. The liquid guide member 21 introduces the bubble liquid into the liquid inlet 1221 of the motion and liquid introduction member 122. The bubble liquid flows into the liquid outlet 1222 through the liquid guide slot 1225 enclosed by the plurality of first peripheral portions 1231*b* and the plurality of second peripheral portions 1224*b*. After the bubble liquid is introduced into some of the bubble forming units 121, the motion and liquid introduction member 122 introduces the bubble liquid into the remaining bubble forming units 121 by motion, thereby completing providing the bubble liquid to all the bubble forming units 121. In addition, when a user uses the bubble machine 1, the control switch 24 is pressed to turn on the power supply 26, so that power will be supplied to the fan 13 too. Air generated by the rotation of the fan 13 is blown towards the bubble forming part 12, and the bubble liquid is blown out to form bubbles. Meanwhile, the swing rod 22 is driven to swing by the motion and liquid introduction member 122, so as to push the bubbles generated by the bubble forming units 121 to be separated from the bubble machine 1, and the bubbles that are separated from the bubble machine 1 are blown out.

The various technical features in the foregoing embodiments may be randomly combined. For concise description, not all possible combinations of the various technical features in the above embodiments are described. However, provided that combinations of these technical features do not conflict with each other, the combinations of the various technical features are considered as falling within the scope of this specification. The foregoing embodiments merely express several implementations of the present disclosure. The descriptions thereof are relatively specific and detailed, but are not understood as limitations on the scope of the present disclosure. A person of ordinary skill in the art can also make several transformations and improvements without departing from the idea of the present disclosure. These transformations and improvements fall within the protection scope of the present disclosure. Therefore, the protection scope of the patent of the present disclosure shall be subject to the appended claims.

What is claimed is:

1. A bubble machine comprising:

a shell; a bubble forming part, arranged on the shell and provided with a plurality of bubble forming units; and a motion and liquid introduction member, arranged on the shell and is provided with a liquid inlet and a liquid outlet, wherein the liquid inlet is configured to allow bubble liquid to flow therethrough into the liquid outlet; the liquid outlet is arranged corresponding to the bubble forming part; and the motion and liquid introduction member is configured to be driven to move to introduce the bubble liquid at the liquid outlet into the plurality of bubble forming units, so that the plurality of bubble forming units are able to generate a plurality of bubbles using introduced bubble liquid when there is an air flow motion in a preset direction;

wherein the bubble machine further comprises a swing rod; the swing rod comprises a connecting portion and a swing portion connected to the connecting portion in a bent manner; one end of the connecting portion is connected to the motion and liquid introduction member, and another end of the connecting portion passes through the bubble forming part; and the swing portion is located on one side of the bubble forming part away from the motion and liquid introduction member, and is configured to be driven, when the motion and liquid introduction member moves, by the motion and liquid introduction member to swing, so as to push the bubbles generated by the bubble forming units to be separated from the bubble machine.

2. The bubble machine according to claim 1 further comprising:

a fan, configured to blow air towards the plurality of bubble forming units to generate the air flow motion in the preset direction;

a transmission device, connected to the motion and liquid introduction member; and a driving device, connected to the fan and the transmission device and configured to: drive the fan to rotate to generate the air flow motion in the preset direction, and drive the motion and liquid introduction member to move through the transmission device.

3. The bubble machine according to claim 2, wherein the driving device comprises a driving main body and an output shaft connected to the driving main body; the output shaft is connected to the fan and the transmission device; the output shaft is provided with a transmission thread;

the transmission device comprises a gear module and a transmission member; the transmission member is provided with a first transmission gear and a second transmission gear; the motion and liquid introduction member is provided with a third transmission gear; the gear module comprises at least one gear; the gear module is meshed with the transmission thread and the first transmission gear, the second transmission gear is meshed with the third transmission gear;

when the driving main body drives the output shaft to rotate, the fan rotates to blow air, and the transmission thread drives the gear module to move; and the gear module drives the transmission member to move through the first transmission gear, so that the second transmission gear drives the motion and liquid introduction member to move.

4. The bubble machine according to claim 3, wherein the shell comprises a shell main body and a fixing member; the shell main body is provided with a mounting port; the fixing member is arranged corresponding to the mounting port; the fixing member is provided with a mounting hole; the bubble machine further comprises a liquid outlet member configured to allow the bubble liquid to flow therethrough; the liquid outlet member is mounted in the mounting hole;

the motion and liquid introduction member comprises a rotating member and a liquid storage member;

wherein the rotating member comprises a base plate provided with the liquid inlet and a liquid guide slot communicated with the liquid inlet, an annularly arranged extending plate corresponding to the liquid inlet and extending from one side of the base plate towards the mounting hole, and a ringlike structure connected to and annularly arranged at an outer edge of the base plate; the ringlike structure is provided with the third transmission gear; the extending plate is connected to the motion and liquid introduction member to communicate the liquid inlet with the liquid outlet member;

the liquid storage member is arranged on one side of the base plate away from the extending plate and is provided with the liquid outlet; and the liquid outlet communicates with the liquid guide slot.

5. The bubble machine according to claim 4, wherein an inner wall of the mounting hole comprises a first portion, a second portion, and a connecting portion connected between the first portion and the second portion; the liquid outlet member comprises a tube body provided with a liquid channel, and a fixed flange arranged at a periphery of the tube body; the tube body is divided by the fixed flange into a first tube portion adjacent to the rotating member and a second tube portion far from the rotating member; the liquid channel is continuous inside the first tube portion and the second tube portion; the first tube portion and the fixed flange are located in the first portion; the extending plate extends into the first portion and is located between the first portion and the first tube portion; the liquid inlet corresponds to the liquid channel inside the first tube portion; the fixed flange is in contact with the connecting portion; and the second tube portion is at least partially located in the second portion.

6. The bubble machine according to claim 5, wherein the bubble machine further comprises a sealing ring; the sealing ring sleeves an outer surface of the first tube portion and abuts between the extending plate and the first tube portion; and the outer surface of the first tube section is provided with a fixing groove; and the sealing ring is at least partially embedded in the fixing groove.

7. The bubble machine according to claim 5, wherein the fixing member comprises an enclosing portion enclosed to define the mounting hole, a plurality of partition plates connected to a periphery of the enclosing portion and spaced apart, and a ring wall structure annularly arranged at and connected to outer edges of the plurality of partition plates; the ring wall structure is mounted on an inner wall of the shell main body; and air from the fan is blown towards the bubble forming part through gaps among the plurality of partition plates.

8. The bubble machine according to claim 7, wherein a limiting slot adjacent to the rotating member is further enclosed between the enclosing portion and the partition plates; the bubble machine further comprises an elastic member; the elastic member is located in the limiting slot and abuts between the rotating member and the fixing member;

and the elastic member is a spring sleeving on the periphery of the enclosing portion.

9. The bubble machine according to claim 7, wherein the fixing member further comprises at least one first fastener connected to the ring wall structure; the bubble forming part is further provided with a second fastener; and the first fastener and the second fastener are engaged with each other to fix the fixing member and a main body of the bubble forming part.

10. The bubble machine according to claim 4, wherein the base plate comprises a first central portion and at least one first peripheral portion connected to a periphery of the first central portion; the first central portion is provided with the liquid inlet defined therein; the liquid guide slot is provided on surfaces of sides of the first central portion and the at least one first peripheral portion adjacent to the liquid storage member;

the liquid storage member comprises a second central portion and at least one second peripheral portion adjacent to a periphery of the second central portion; the second central portion is provided with the liquid outlet defined therein; the second central portion corresponds to the first central portion; and the at least one second peripheral portion corresponds to the at least one first peripheral portion.

11. The bubble machine according to claim 10, wherein the at least one first peripheral portion is a plurality of first peripheral portions, and the plurality of first peripheral portions are spaced apart in sequence; the at least one second peripheral portion is a plurality of second peripheral portions, and the plurality of second peripheral portions are spaced apart in sequence and are in one-to-one correspondence to the plurality of first peripheral portions; and air from the fan is blown towards the bubble forming part through gaps among the plurality of partition plates, gaps among the plurality of first peripheral portions, and gaps among the plurality of second peripheral portions in sequence.

12. The bubble machine according to claim 11, wherein the liquid guide slot comprises a plurality of liquid guide sub-slots communicating with the liquid inlet; each liquid guide sub-slot extends from the liquid inlet towards one of the first peripheral portions; the liquid storage member is further provided with a liquid inlet slot arranged on surfaces of sides of the second central portion and the plurality of second peripheral portions adjacent to the rotating member; and the liquid storage member abuts against the base plate, so that the liquid inlet slot communicates with the liquid guide sub-slots.

13. The bubble machine according to claim 12, wherein the first central portion and the plurality of first peripheral portions form a boss structure; the liquid guide sub-slots are arranged on the boss structure; a shape of the boss structure is adapted to the liquid inlet slot, so that the boss structure is arranged in the liquid inlet slot; a top surface and a side surface of the boss structure are in contact with a bottom wall and a side wall of the liquid inlet slot respectively;

the liquid storage member is further provided with a liquid outlet slot arranged on surfaces of sides of the plurality of second peripheral portions adjacent to the bubble forming part; the bubble forming units comprise enclosure wall structures with bubble outlets; the plurality of bubble forming units are annularly arranged at intervals; the bubble forming part further comprises a mounting portion annularly arranged at peripheries of the plurality of bubble forming units, and connectors connected between the mounting portion and the bubble forming units; and the mounting portion is connected to the shell main body to fix the bubble forming part on the shell.

14. The bubble machine according to claim 4, wherein the bubble machine further comprises a liquid guide member; the liquid outlet member communicates between the liquid inlet and the liquid guide member; one end of the liquid guide member away from the liquid outlet member is configured to obtain the bubble liquid from a bubble liquid tank;

the liquid guide member is further connected to the gear module, so that when the gear module moves under driving of the driving device, the gear module applies a driving force to the liquid guide member, and then the liquid guide member generates a suction force to suck the bubble liquid from the bubble liquid tank.

15. The bubble machine according to claim 14, wherein the gear module comprises a first gear, a second gear, and at least one third gear; the first gear, the second gear, and the at least one third gear are all mounted on the shell main body through a mounting shaft; the first gear is engaged with the transmission thread; the second gear is engaged with the first gear; the liquid guide member comprises a conveying tube made of a flexible material; the liquid guide member is at least partially sandwiched between a gear surface on one side of the second gear and an inner surface of the shell main body, so that when the second gear rotates, the liquid guide member generates a suction force to suck the bubble liquid from the bubble liquid tank; and the at least one third gear is engaged with the first gear and the first transmission gear, respectively.

16. The bubble machine according to claim 15, wherein the at least one third gear comprises two third gears; one of the two third gears is engaged with the first gear and the other of the two third gears, respectively, and the other of the two third gears is engaged with the first transmission gear;

the output shaft rotates around a first preset axial direction; the first gear, the second gear, and at least one third gear all rotate around a second preset axial direction; the first preset axial direction is perpendicular to the second preset axial direction; and when the at least one third gear rotates around the second preset axial direction, the first transmission gear causes the transmission member to rotate around the first preset axial direction, thereby driving the motion and liquid introduction member to rotate around the first preset axial direction.

17. The bubble machine according to claim 16, wherein the transmission member comprises a transmission shaft connected between the first transmission gear and the third transmission gear and extending in the first preset axial direction.

18. The bubble machine according to claim 2, wherein the bubble machine further comprises a control switch, a circuit board, and a power supply; the circuit board is electrically connected to the control switch, the power supply, and the driving device; and when the control switch is operated, the circuit board generates a triggering signal and controls the driving device to work to: drive the fan to rotate and drive the motion and liquid introduction member to move.

19. The bubble machine according to claim 1, wherein the bubble machine further comprises a backflow member; the backflow member is mounted on the shell and corresponds to a bottom of at least one of the bubble forming part and the motion and liquid introduction member; and the backflow member is configured to: receive leaking liquid from at least one of the bubble forming part and the motion and liquid introduction member and introduce the leaking liquid into the bubble liquid tank.

* * * * *